United States Patent [19]

Rass et al.

[11] 3,949,790

[45] Apr. 13, 1976

[54] APPARATUS FOR JOINING TWO COILS OF WIRE

[76] Inventors: Alfred Rass, Auf Schwarzfeld 6; Walter Rass, Am Herrenbrunnchen 86; Rudolf Schneider, Parkstr. 16, all of 55 Trier, Germany

[22] Filed: Oct. 29, 1974

[21] Appl. No.: 518,512

[30] Foreign Application Priority Data

Nov. 2, 1973 Germany ..... 2354979

[52] U.S. Cl. ..... 140/112; 228/47; 100/7

[51] Int. Cl.[2] ..... B21F 15/08

[58] Field of Search ..... 242/129, 80, 79; 219/57, 219/58; 269/289; 140/111, 112; 29/200, 484; 228/4, 19, 47, 57; 57/22; 100/233, 3, 7

[56] References Cited

UNITED STATES PATENTS

| | | | |
|---|---|---|---|
| 2,263,889 | 11/1941 | Rose | 242/79 |
| 2,756,308 | 7/1956 | Powell | 219/57 |
| 3,266,412 | 8/1966 | Rodenbusch | 100/3 |
| 3,386,684 | 6/1968 | Null | 242/79 |
| 3,439,814 | 4/1969 | Morain | 100/7 |

*Primary Examiner*—Lowell A. Larson
*Attorney, Agent, or Firm*—Robert W. Beach; R. M. Van Winkle

[57] ABSTRACT

In order to join two coils of wire to form a single continuous longer coil, the two coils are placed on side flaps of a table, the ends of the coils welded together and the flaps raised to push the coils together to interengage their turns to form a single continuous unitary longer coil.

3 Claims, 4 Drawing Figures

APPARATUS FOR JOINING TWO COILS OF WIRE

FIELD OF THE INVENTION

This invention relates to apparatus for joining two coils of wire to form a continuous longer coil.

For technical production reasons wire, for example for the production of reinforcing mats is produced in specific lengths. This wire is then rolled up into coils and transported from the place of production to the subsequent treatment place.

Thus, for example, wire coils having a weight of 400 kg can be produced. However, it would be advantageous to have wire rolls with double the amount of wire, in other words 800 kg. Therefore there exists the necessity of combining two wire coils into a single continuous coil in such a way that a continuous wire of double the length is obtained.

Upon the joining two wire coils, however, there is the difficulty that no loop must be formed, since otherwise a satisfactory subsequent treatment of the wire is not possible.

OBJECT OF THE INVENTION

An object of the invention therefore is to provide apparatus for the joining of two wire coils by which the two wire coils are joined in a continuous larger coil with no kinks or loops at the joint.

BRIEF SUMMARY OF THE INVENTION

The invention provides apparatus for combining two coils of wire having a supporting table including a central portion and an upwardly swingable side flap on opposite sides of the central portion, each side flap being adapted to carry one wire coil. The central portion has, between the two side flaps, a width which corresponds to the sum of the axial heights of the two wire coils. A welding device is arranged above central portion of the table.

Each of the two side parts of the supporting table are advantageously connected to a hydraulic, pneumatic or mechanical elevating device. The elevating devices for both flaps can be actuated synchronously.

In accordance with a further development of the invention, there can be arranged above the supporting table a device for gripping the ends of the wires and transferring them to the welding device.

Furthermore, the welding device is advantageously movable transversely to the ends of the wires.

In a further development there can be arranged on the centre part of the supporting table a push-out device for the formed larger coil.

Figure 3:
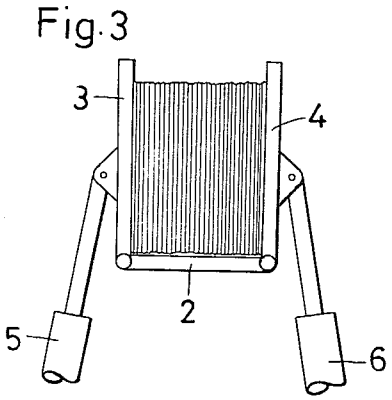
FIG. 3 is a side elevation of the device of FIGS. 1 and 2, but with side flaps of the supporting table swung up.
Figure 4:
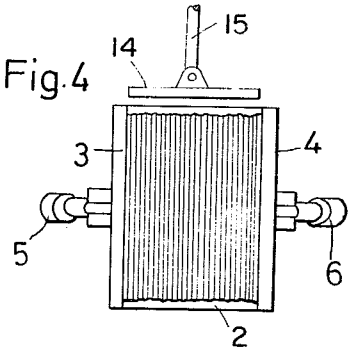
FIG. 4 is a top plan of the device in the condition of FIG. 3.
Figure 1:
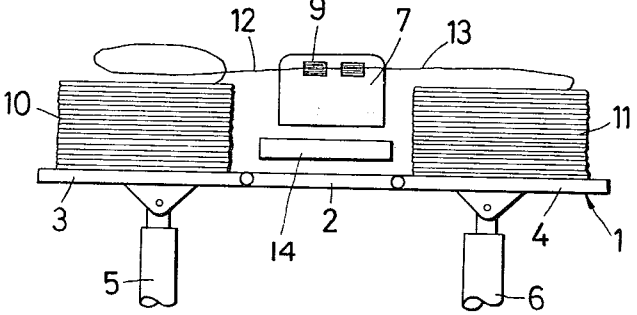
FIG. 1 is a diagrammatic side elevation of apparatus in accordance with the invention having a horizontal supporting table and wire coils lying thereon.

The device in accordance with FIGS. 1 to 4 has a supporting table 1 which has a fixed centre part 2, and, at each side, a respective side flap 3, 4 which can be swung into upright positions. The side flaps 3 and 4 are hingedly connected to the centre part 2. Pivotally connected to the underside of each side part 3, 4 is a respective hydraulic or pneumatic elevating device 5, 6, which devices can be actuated synchronously.

Arranged above the centre part 2 of the supporting table 1 is a welding device 7 which can be reciprocated in the direction of the arrow 8, and furthermore a gripping device 9 is provided.

Figure 2:
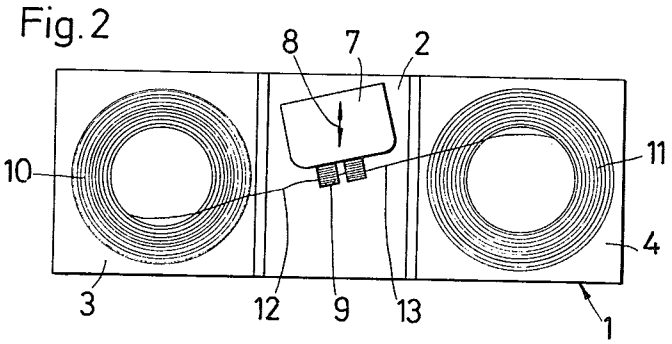
FIG. 2 is a top plan of the device of FIG. 1.

In order to join two wire coils 10 and 11, these latter are first of all placed onto the side flaps 3 and 4 of the supporting table, as FIG. 2 shows. Then the wire ends 12 and 13 of these two coils are drawn out, whereby a certain initial stress arises. The ends 12, 13 of the wire coils, held by gripping device 9, are then joined together and welded together.

Next the two side flaps 3 and 4 of the supporting table are swung up, whereby the axes of the two wire coils are turned through 90° and the coils are moved towards one another.

By the upward swinging of the two side flaps 3 and 4, the coils are now combined into a single wire coil and receive a pressure which causes the individual rounds to become interlocked to form a unitary single coil which is transportable. By this means the otherwise usual separate operation of rewinding the coils to form a single coil is obviated.

After the binding-together, the single larger coil is pushed out by a push-out device 14 mounted on a movable arm 15 adjacent to the centre part of the supporting table.

We claim:

1. Apparatus for combining two coils of wire comprising a supporting table including a central portion having a width substantially equal to the sum of the axial heights of the two coils and two swingable side flaps disposed at opposite sides of said central portion, each side flap being adapted to carry a coil with its axis disposed substantially vertically, welding means disposed adjacent to said supporting table central portion, means for gripping an end of each coil supported on each of said side flaps to be welded together by said welding means, and elevating means for synchronously swinging said side flaps about parallel pivot axes from substantially horizontal positions to substantially upright positions and thereby depositing the cables on said supporting table central portion with their axes substantially aligned.

2. The apparatus defined in claim 1, in which the welding means is reciprocable along a path between and substantially parallel to the side flap pivot axes between a position overlying the table central portion and a position clear of the table central portion.

3. The apparatus defined in claim 1, and pusher means extendible between the side flaps with the flaps in their substantially vertical positions for pushing a combined coil from the supporting table central portion and retractable to a position clear of the side flaps.

* * * * *